US011517090B2

(12) United States Patent
Wint

(10) Patent No.: US 11,517,090 B2
(45) Date of Patent: Dec. 6, 2022

(54) HAIR WAVER SYSTEMS

(71) Applicant: Gail Wint, West Palm Beach, FL (US)

(72) Inventor: Gail Wint, West Palm Beach, FL (US)

( * ) Notice: Subject to any disclaimer, the term of this patent is extended or adjusted under 35 U.S.C. 154(b) by 68 days.

(21) Appl. No.: 17/160,260

(22) Filed: Jan. 27, 2021

(65) Prior Publication Data

US 2022/0232940 A1 Jul. 28, 2022

(51) Int. Cl.
*A45D 2/38* (2006.01)

(52) U.S. Cl.
CPC ..... *A45D 2/38* (2013.01)

(58) Field of Classification Search
CPC ... A45D 2/02; A45D 2/08; A45D 2/38; A45D 2/148; A45D 2/24; A45D 2/2407; A45D 7/00; A45D 2007/002; A45D 2007/004; A45D 2007/005; A45D 2002/003
See application file for complete search history.

(56) References Cited

U.S. PATENT DOCUMENTS

2004/0031501 A1* 2/2004 Walsh ..... A45D 2/40 132/225
2018/0168311 A1* 6/2018 Offord ..... A45D 2/38

FOREIGN PATENT DOCUMENTS

FR 2632833 A1 * 12/1988
WO WO-2014110615 A1 * 7/2014 ..... A45D 2/38

* cited by examiner

*Primary Examiner* — Rachel R Steitz
*Assistant Examiner* — Karim Asqiriba

(57) ABSTRACT

A hair waver system is presented. The system includes a top waver. The system also includes a bottom waver configured to mate with the top waver. The system further includes a plurality of connectors designed to connect the top waver with the bottom waver and structured to maintain hair designated to be styled between the top waver and the bottom waver during hair styling evolutions. The system also provides for hair styling without the need for hot irons or chemicals.

2 Claims, 17 Drawing Sheets

HAIR WAVER SYSTEMS

FIELD OF THE INVENTION

The present invention relates generally to hair styling systems, and more particularly, to hair waver systems, which utilize singular and multiple interlocking hair wavers to allow hair styling without hot irons or perms to achieve the desired hair style.

BACKGROUND OF THE INVENTION

Many methods and devices have been unsuccessfully attempted to style hair without the use of chemicals or hot irons, Many of these previous attempts were costly and cumbersome to use.

Quite often hair stylists utilize perm chemicals to treat hair to achieve a desired hair style. The use of perm chemicals damages hair and prevents the natural hair to return the natural luster and natural curls.

Further, previous methods utilized to treat hair included using hot irons, heat applied directly to hair in conjunction with a plurality of chemicals to achieve a desired hair style. All of these hair treatments damages hair and can ultimately lead to permanent hair luster loss Additionally, these previous damaging treatments were costly, cumbersome due to the equipment involved and the dwell time of the chemicals, and time consuming.

Accordingly, there is an established need for hair wavers which solve at least one of the aforementioned problems. Further, there is an established need for hair waver systems which can be utilized more efficiently and effectively and provide desired hair styles without damaging hair.

SUMMARY OF THE INVENTION

The present invention is directed to innovative and cost-effective hair waver systems which can be utilized to style hair without using damaging hair chemicals, hot irons, and heat applied to a person's hair. Further, the present invention is directed to innovative, ergonomically, designed, hair waver components which can be used individually or in combination to allow styling hair evolutions to occur while protecting a person's natural hair quality characteristics.

A hair waver system is presented. The system includes a top waver. The system also includes a bottom waver configured to mate with the top waver. The system further includes a plurality of connectors designed to connect the top waver with the bottom waver and structured to maintain hair designated to be styled between the top waver and the bottom waver during hair styling evolutions. The system also provides for hair styling without the need for hot irons or chemicals.

In embodiments, the system can include six-inch long hair waver components.

In embodiments the system can include 3.5-inch-wide hair waver components.

In embodiments the system can include hair waver components with a 0.3 cm height.

In embodiments the system can include hair waver components with wave depths of 0.5, 0.75, and 1.5 inches.

In embodiments the system hair waver components with curved components with radii of 0.5, 1, 2, 4, 6 inches and any radii in between.

In embodiments the system can include openings arranged on hair waver components. The openings may be circular, oval, triangular, rectangular, and/or trapezoidal.

In embodiments the system can include opening wherein the openings go through the entire hair waver component allowing free communication of air, water, gas, or fluid through the opening.

In embodiments the system can include tapered openings, wherein the tapered openings have a smaller opening on one of the surfaces of a hair waver component and a larger opening on the opposite side surface of the hair waver component.

In embodiments the system can include a plurality of openings arranged on hair waver components.

In embodiments the system can include a plurality of openings arranged on hair waver components configured in an array fashion, symmetrical pattern, or non-symmetrical pattern.

In embodiments the system can include a plurality of openings arranged on hair waver components spaced apart by 0.1, 0.2, 0.5, 1, or 2 inches or any distance in between.

In embodiments the system can include a plurality of openings arranged on hair waver components, the plurality of openings can be of uniform opening size or can vary throughout their placement on the hair waver components.

In embodiments the system can include a plurality of openings with an opening dimension of 0.1, 0.2, 0.3, 0.4, 0.5 or 1 inch or any dimension in between.

In an embodiment of the present invention, the system can include a plurality of hair waver components interconnected with one another to style longer hair.

In another embodiment, the system can also include components made of Thermoplastic polyurethane (TPU).

In embodiments, the system can include hair waver components which can be used regularly with a plurality of elapsed time frames between use without damaging a person's hair.

In embodiments the system can include wavers configured as loose hair wavers and designed to create loose waves.

In embodiments the system can include wavers configured as beach hair wavers and designed to create medium waves.

In embodiments the system can include wavers configured as exotic hair wavers and designed to create tight waves or super wavy hair.

In embodiments, the system can include waver components with a top and a bottom section.

In embodiments the system can include layers, the layers configured to directly connect to the hair waver components and act as an interface with a person's hair.

In another aspect, the system can also include an anti-microbial coating.

In another embodiment, the system can also include materials, such as but not limited to aluminum, steel, composites, synthetic plastics, and/or rubberized material. The material structured to provide enhanced ability to style a person's hair and to provide resistance to infectious diseases, water resistance and/or anti-microbial properties.

In yet another embodiment, the system can include manufacturing methods such as but not limited to 3-D printing, injection molding, laser cutting, CNC processes, extrusion, dye cutting and/or stamping, hand cutting, and/or sawing configured to manufacture hair waver components. The methods configured to minimize production time and/or cost.

In an aspect, the system can include coating materials. The coating materials arranged to mitigate microbial and/or viral transmission. Further, the coatings can be configured to retard moisture and/or eliminate unwanted biological growth.

In another embodiment, the system can also include polypropylene configured to produce the system with injection molding.

In embodiments, the system can include openings at the top and bottom of the waver components. The openings configured to allow air flow through hair waver components and to allow any moisture in the hair to evaporate or to physically drain. Also, the openings can be arranged to allow routine cleaning of hair waver components and allowing cleaning water to exit the openings to allow proper drying.

In embodiments the system can include hair waver components wherein the hair waver components can include plastic rectangular, square, oval, round, or trapezoidal shapes.

In embodiments the system can include hair waver components which can include parallel-sided plastic.

The system can include anti-friction coatings on surfaces configured to interconnect a plurality of hair waver components.

In embodiments the system can include a plurality of interlocking hair waver components configured to style 6 inch ear length hair, 8 inch below the ear length hair, 10 inch chin length hair, 12 inch shoulder length hair, 14 inch upper back length hair, 16 inch bra strap length hair, 18 inch shoulder length hair, 20-22 inch mid back length hair, 24-26 lower back length hair, 28 inch waist length hair, and 30 inch hip length hair.

The system can include click and slide connectors configured to mate tube to female pipe attachment with unit connector to go inside a cavity to accommodate longer hair.

The system can include magnet strips at the end of each cover and bottom waver as well as recessed area to connect each unit smoothly.

The system can also include snap on fasteners at the end of each over and bottom waver and on the outer face for connecting units.

The system can include edge to edge connectors configured to mate tube to female pipe attachment running along the edges of the cover and waver to avoid hair getting caught when joining the pieces together.

The system can also include clip clamp connectors configured to provide a hinged clip to easily and quickly attach and detach waver as one piece. The clip clamp connectors may be oriented to be positionable on any portion of the hair waver components.

The system can include swing and lock connectors structured to provide a hair waver component with multiple arms along edges of the component that can clamp down hair once fastened. The swing and lock connectors may be designed to eliminate the need for a separate cover layer since the arms are the cover.

The system can include connectors with male tubes on the edges of the cover waver and female pipe attachment running along the edges of the bottom waver. The end face of each waver can have a connector and the top face can include a cavity. This configuration would allow to first connect the bottom waver to another bottom waver and the cover to another cover thereby sandwiching the hair. The system can also include dovetail connections.

The system can also include four small disc magnets on each corner of the waver, the four small disc magnets sized such that all four would fit on a surface of a penny. In embodiments, a plurality of hair waver components can join with one another by arranging one waver below previous sets of wavers. The small disc magnets can function to connect top and bottom wavers as well as connect to other wavers.

The system can also include twisted lock clip connectors configured to allow users to open the waver component like a book place the hair between the two wavers and close the clip lock the waver system on the hair being styled. This system provides the benefit of providing wavers which are already aligned and fixed on small hinges on one edge.

These and other objects, features, and advantages of the present invention will become more apparent from the attached drawings and the detailed description of the preferred embodiments, which follow. It is understood, that the drawings are designed for the purposes of illustration and not as a definition of the limits of the embodiments of the present invention. It should be further understood that the drawings are not necessarily drawn to scale and are merely, intended to conceptually illustrate the methods and systems described herein.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

DETAILED DESCRIPTION

The following detailed description is exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
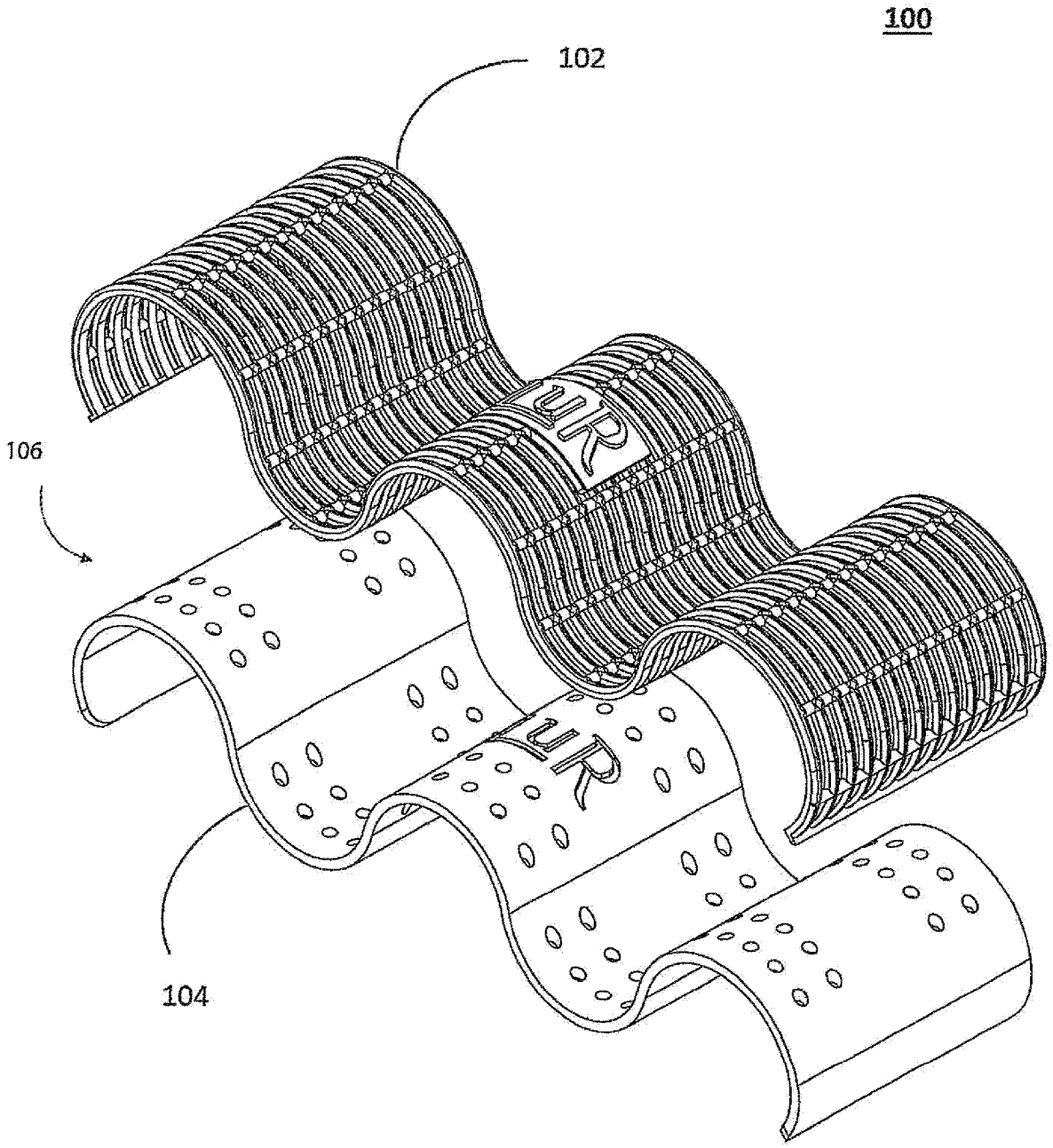
FIG. 1 presents a top perspective view of a top and bottom hair waver component, in accordance with an embodiment of the present invention.

Referring initially to FIG. 1, a top perspective view of a waver hair system including a top waver 102 and a bottom waver 104 are shown. The top waver 102 and bottom waver 104 can be configured to have symmetric symmetries 106 such that top waver 102 and bottom waver 104 can mate.

Figure 2:
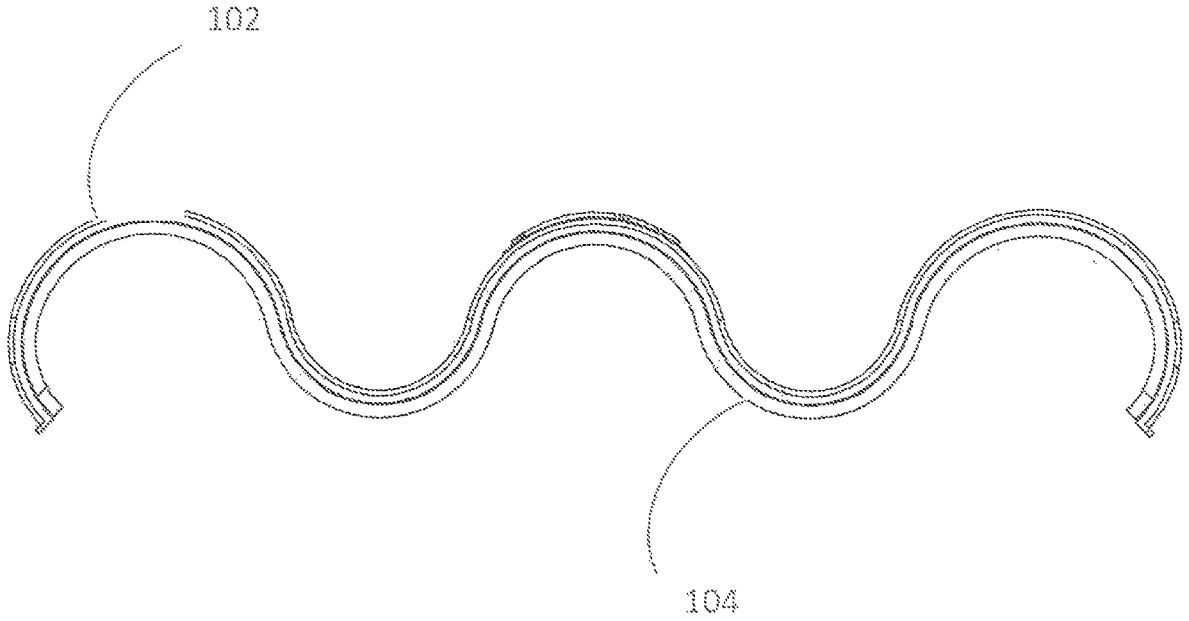
FIG. 2 presents a side view of an embodiment of the present invention.

FIG. 2 displays a side view of a waver system 100 with the top waver 102 and the bottom waver 104 mated. In embodiments the top waver and bottom waver 104 can be held together with connectors located on ends to the top waver and bottom waver. In other embodiments not shown, the waver system 100 can be held together with a plurality of connectors positionable on the top waver 102 and bottom waver 104 and include, but not limited to rigid connections, magnetic connections, hinged connections, and/or clip on connections.

Figure 3:
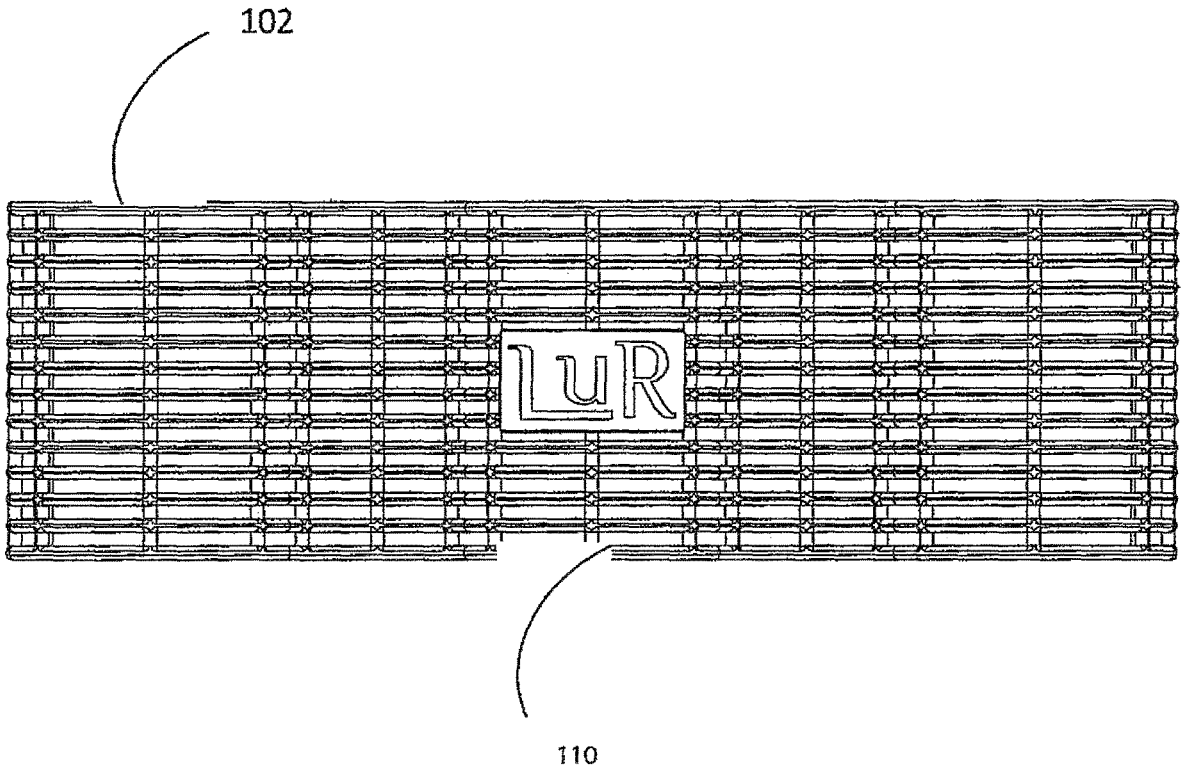
FIG. 3 presents a top view of a hair waver system.

FIG. 3 is a top view of a top waver 102. In embodiments as shown the top waver 102 can have opening configured with a plurality of openings 110 with a plurality of opening dimensions. In embodiments not shown, the plurality of openings 110 can also be symmetrically and/or unsymmetrically placed on the top waver 102.

Figure 4:
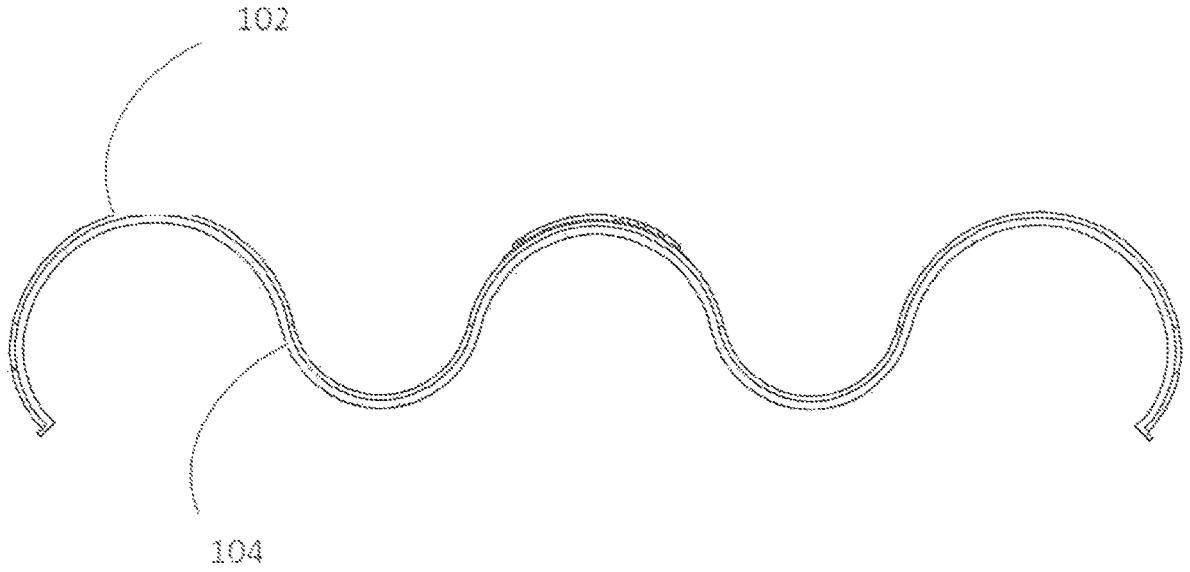
FIG. 4 presents a side view of an embodiment of a hair waver system.

FIG. 4 displays a side view of a waver system 100 with the top waver 102 and the bottom waver 104 mated. In embodiments the top waver and bottom waver 104 can be held together with connectors located on ends to the top waver and bottom waver. In other embodiments not shown, the waver system 100 can be held together with a plurality of connectors positionable on the top waver 102 and bottom waver 104 and include, but not limited to rigid connections, magnetic connections, hinged connections, and/or clip on connection devices.

Figure 5:
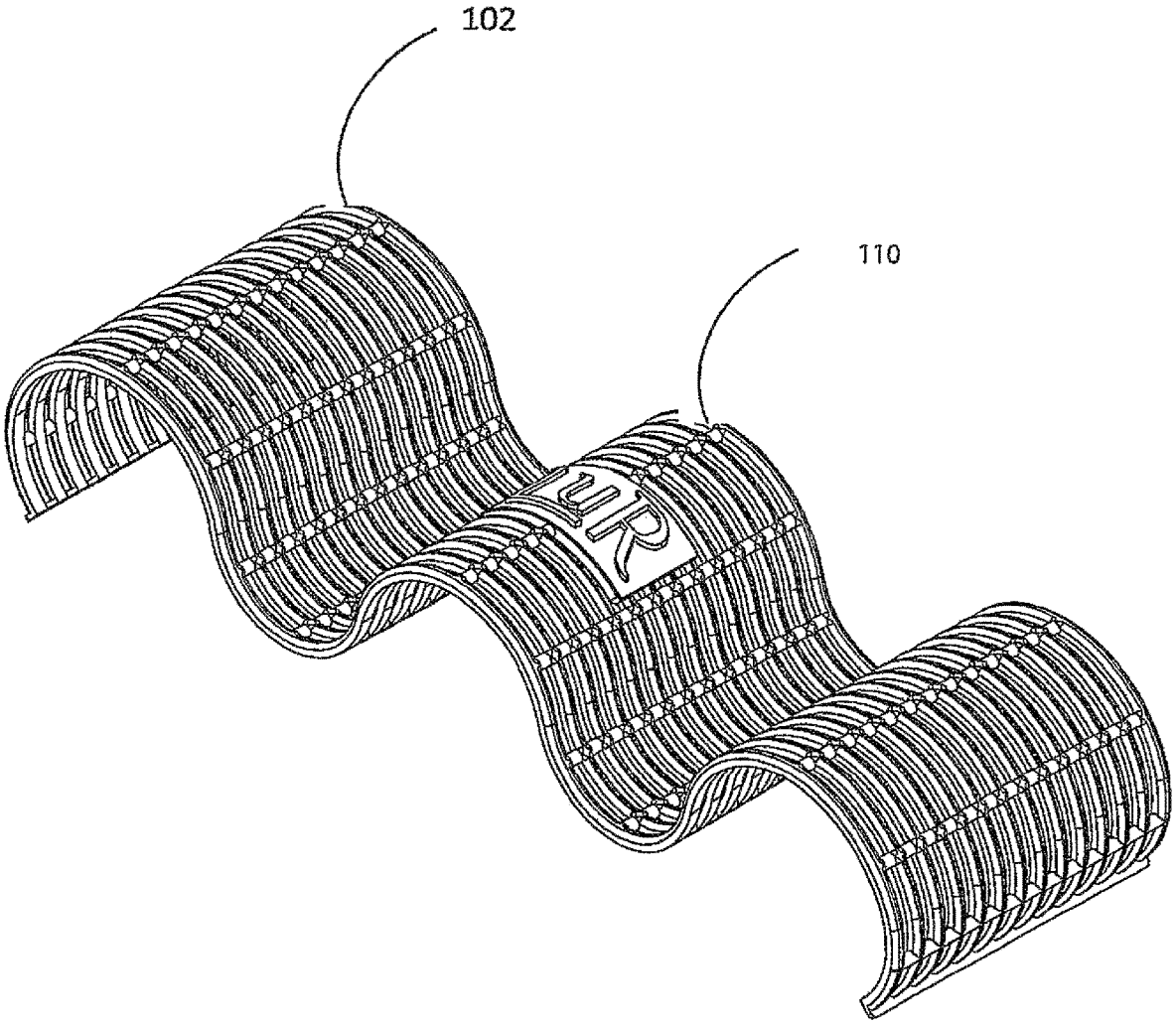
FIG. 5 presents a top perspective view of a top hair waver component.

As best seen in FIG. 5, showing a top perspective view of a top waver 102, the system 100 can include a top waver 102 and a plurality of openings 110.

Figure 6:
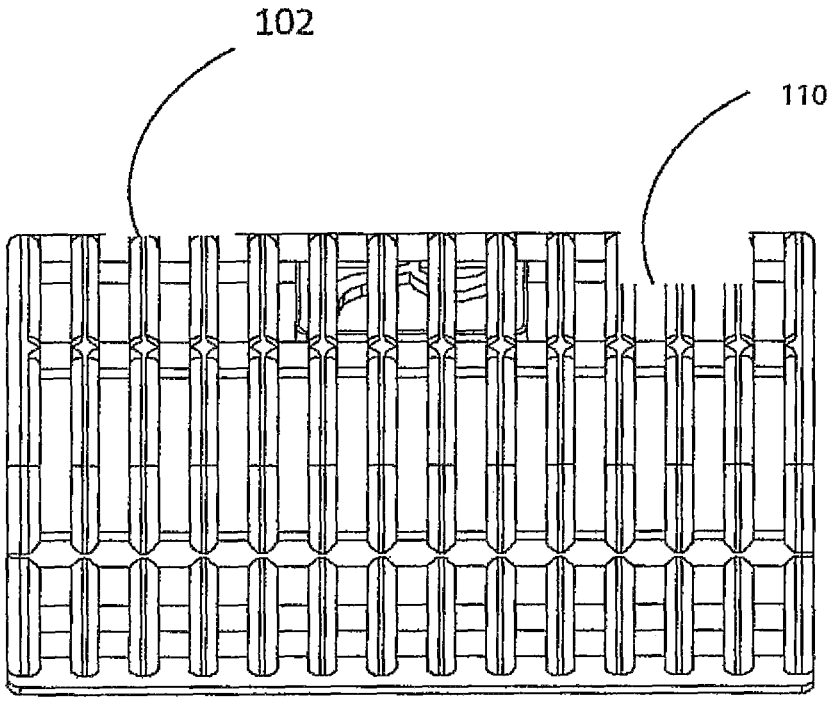
FIG. 6 presents a bottom view of a top hair waver component.

Referencing FIG. 6, displaying a side view of a top waver, it can be seen that the openings 110 positionable on the top waver can include slotted openings which can be configured to run on parallel paths across the top waver 102.

Figure 7:
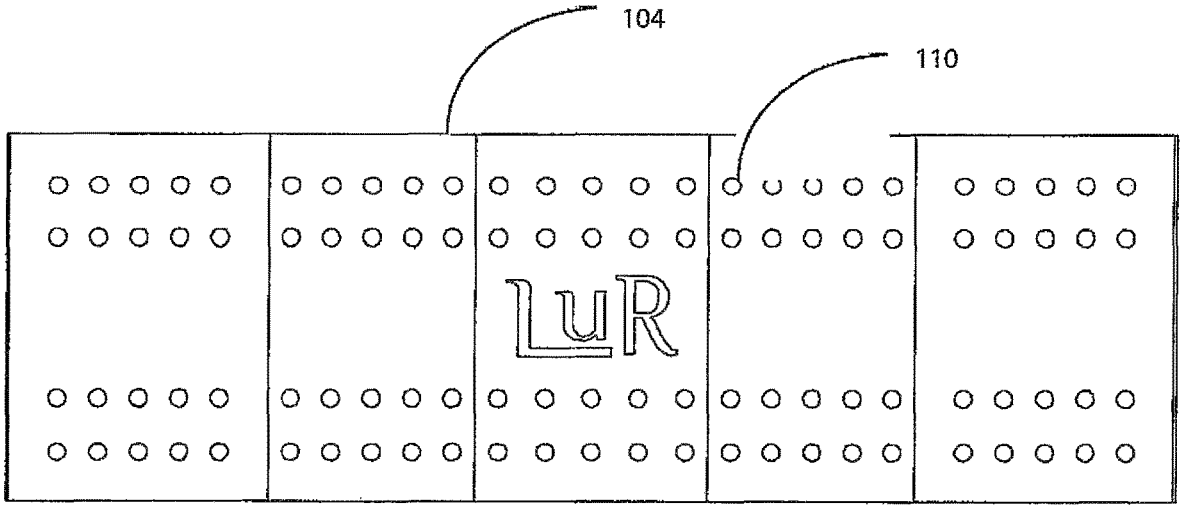
FIG. 7 presents a top view of a bottom hair waver component.

FIG. 7 illustrates a top view of the bottom waver 104 with a plurality of openings 110 positioned on the bottom waver.

Figure 8:
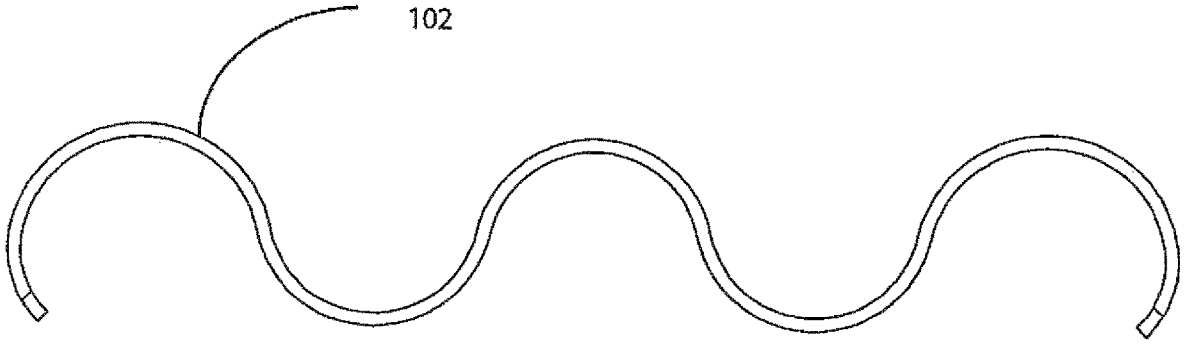
FIG. 8 presents a side view of hair waver component.

FIG. 8 shows a side view of a bottom waver 104. In embodiments the bottom waver can multiple curved portions.

Figure 9:
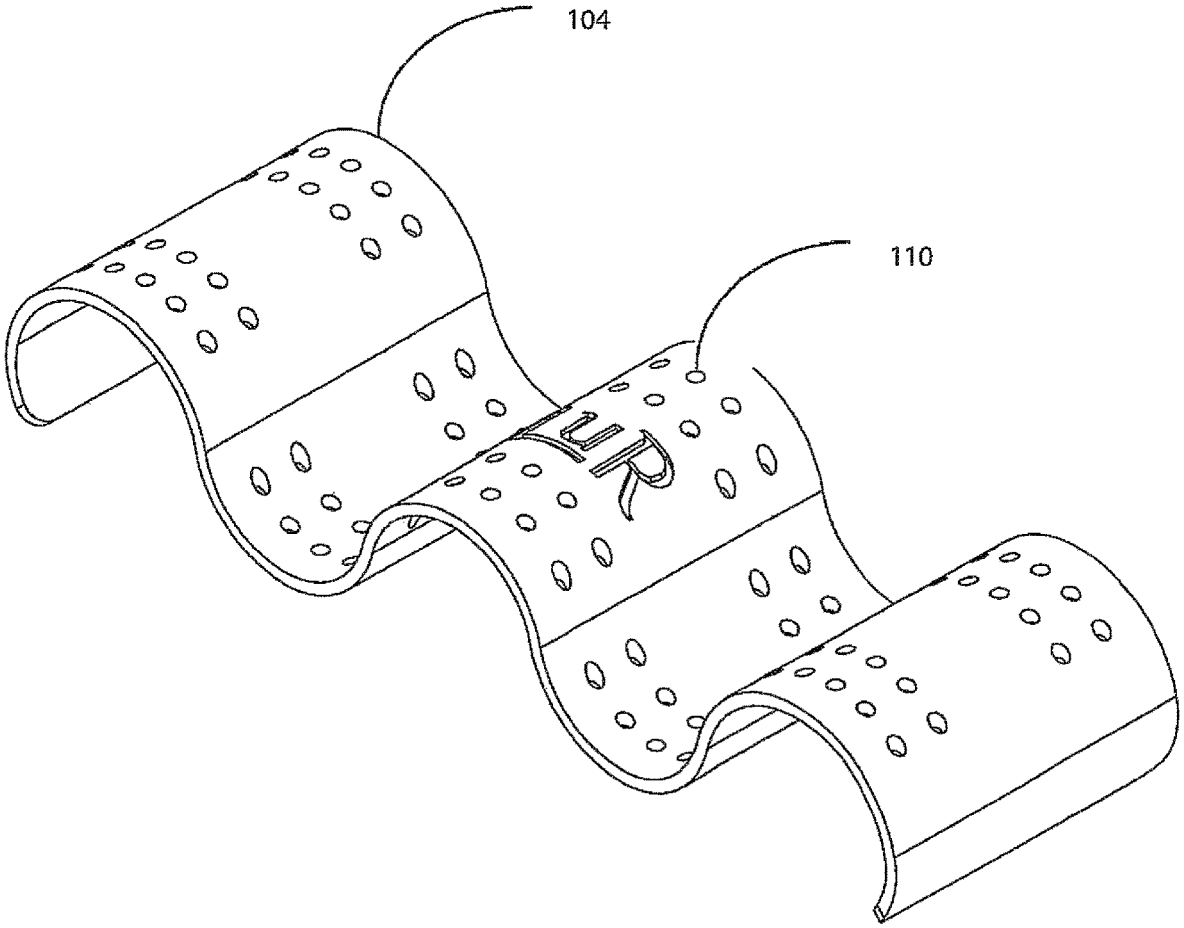
FIG. 9 presents a top perspective view of a top of a bottom hair waver component.

As seen in FIG. 9, a top perspective view of the bottom waver can include arrays of openings 110 arranged in parallel paths on the bottom waver 104.

Figure 10:
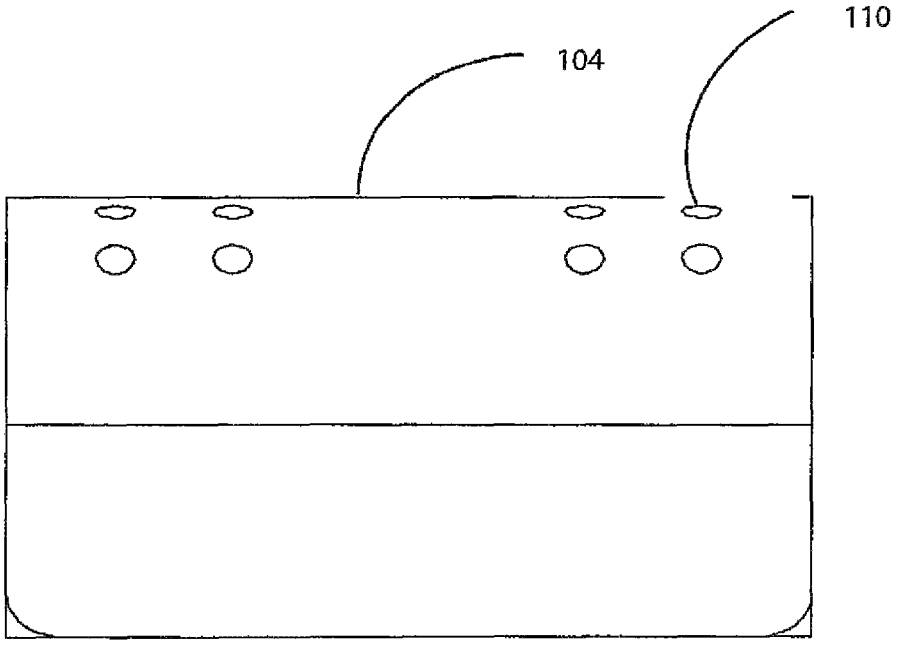
FIG. 10 presents a side view of a bottom hair waver component.

FIG. 10 shows a side view of the bottom waver 104 an in embodiments the openings 110 can be configured along a length of the bottom waver.

Figure 11:
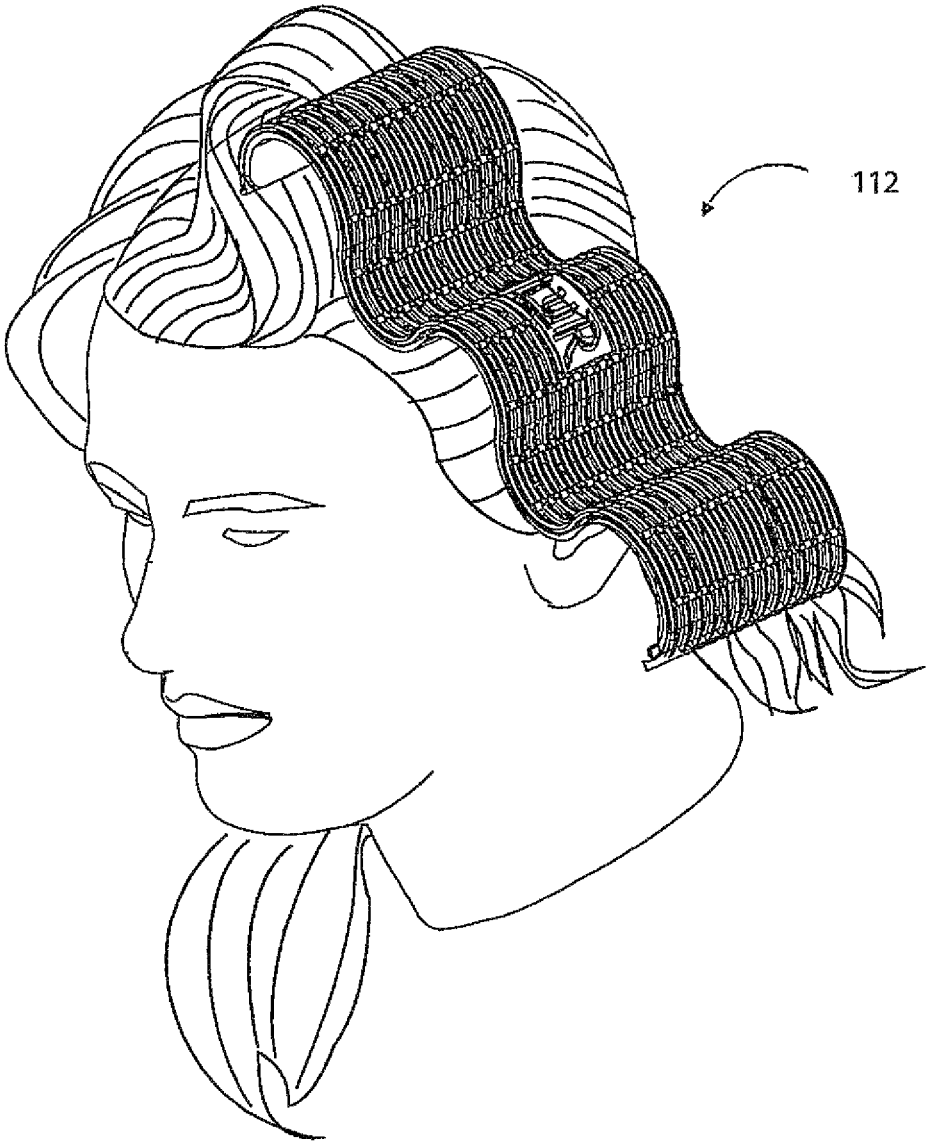
FIG. 11 present a hair waver system deployed on the hair of a person.

Turning to FIG. 11, an embodiment of the present invention is shown with the hair waver system 100 deployed and attached 112 to carry out the hair styling function.

Figure 12:
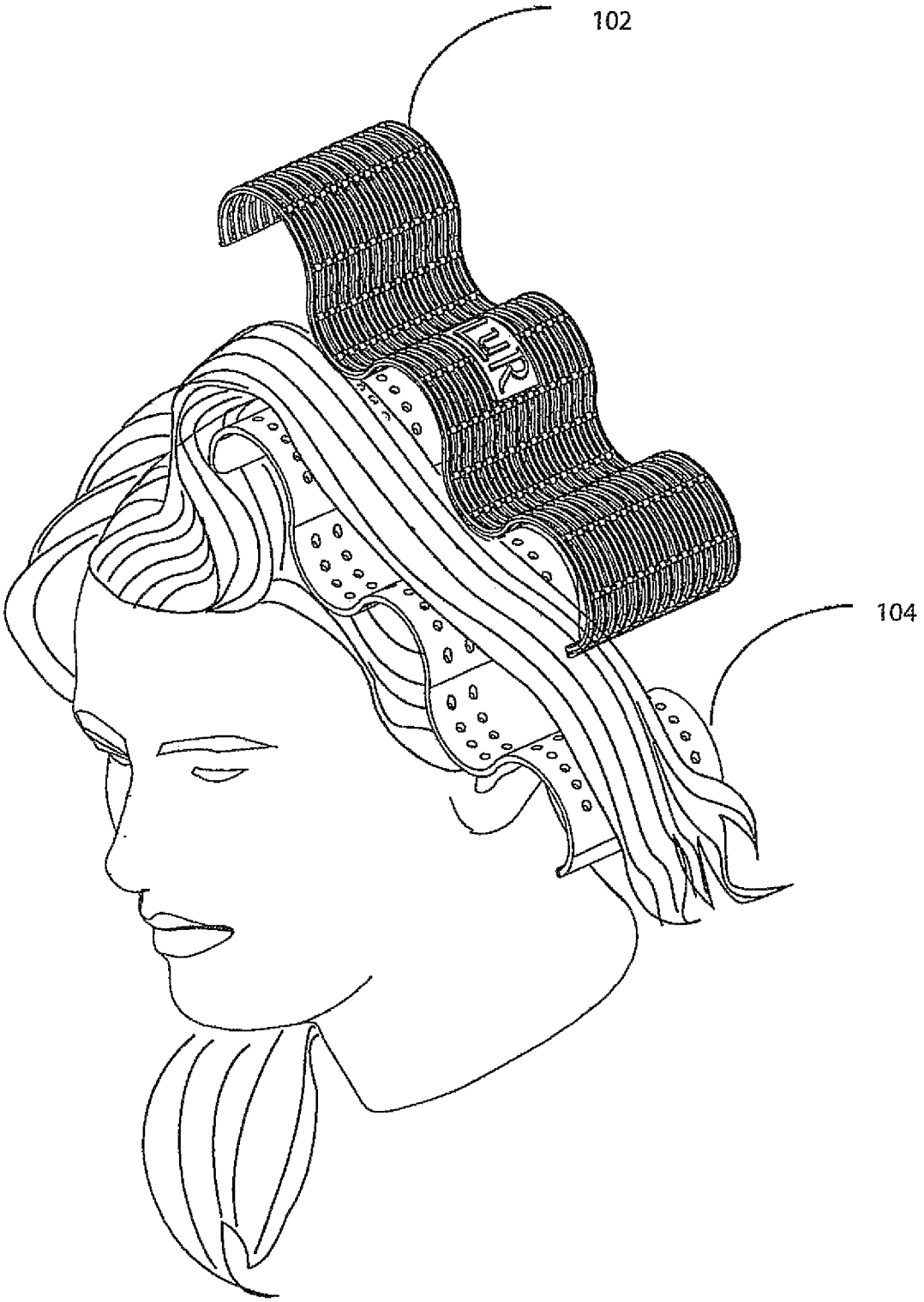
FIG. 12 presents the top and bottom components of a hair waver system in preparation to being applied.

Illustrated in FIG. 12 is an exploded perspective view showing the top waver 102 being placed in position to mate with the bottom waver 104 with the hair designated to be styled is placed in between the top waver 102 and the bottom waver 104.

Figure 13:
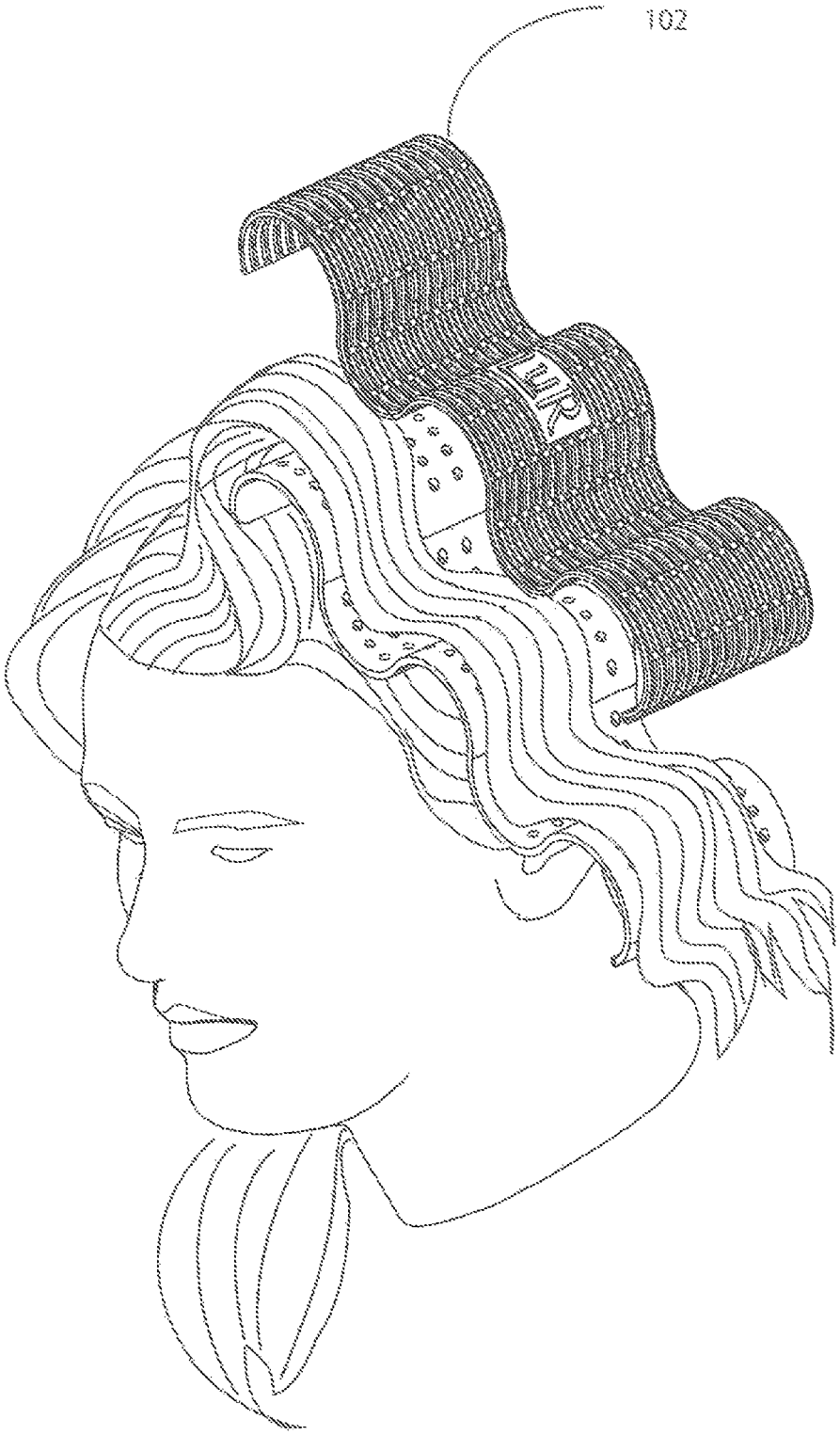
FIG. 13 presents the top and bottom components of a hair waver system in preparation to being applied.

As seen in FIG. 13 is an exploded perspective view showing the top waver 102 being placed in position to mate with the bottom waver 104 with the hair designated to be styled being placed in between the top waver 102 and the bottom waver.

Figure 14:
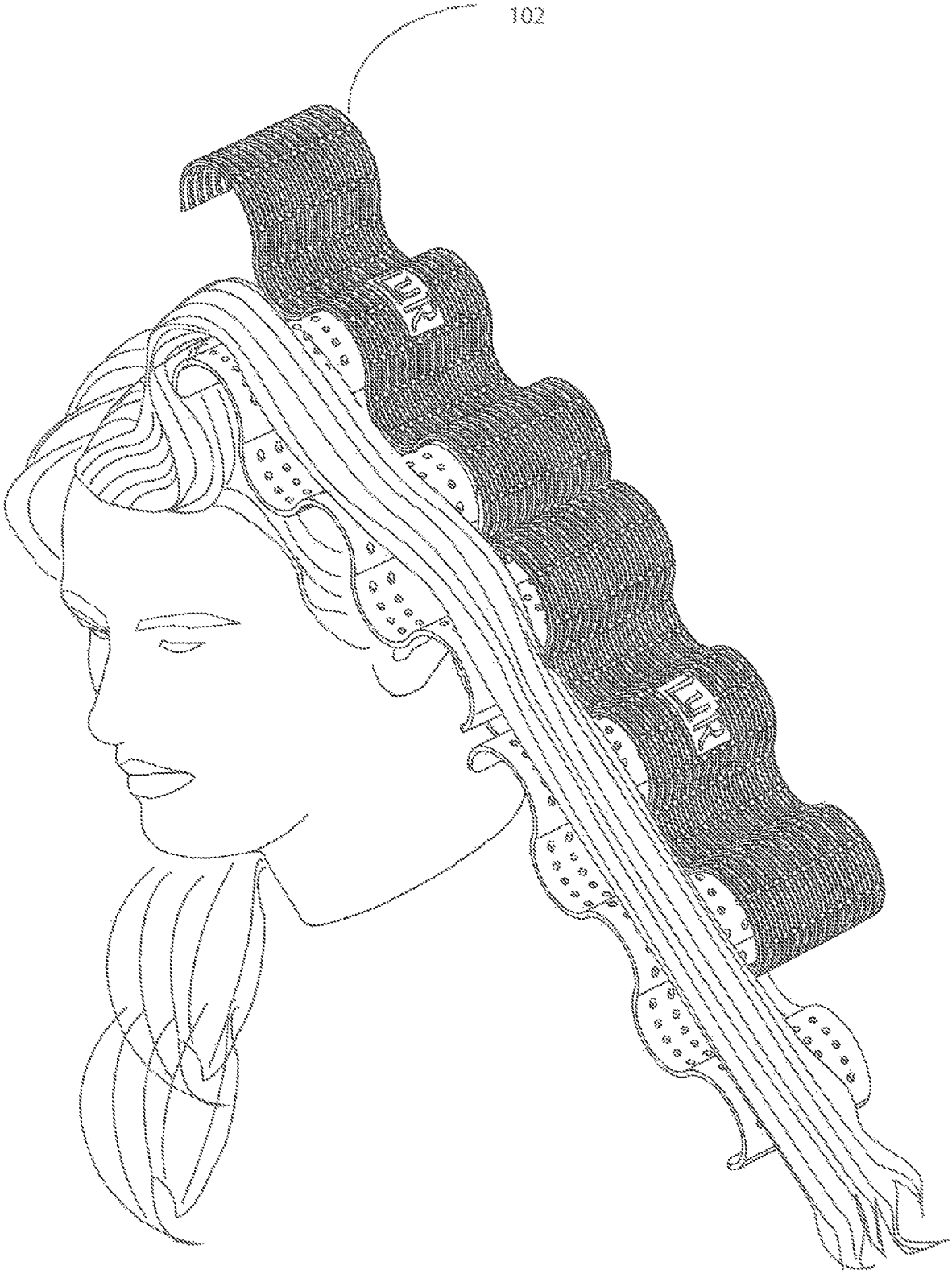
FIG. 14 presents interlocked components of a hair waver system in preparation to being applied.

FIG. 14 displays an embodiment of the present invention by interconnecting one or more hair waver systems 100 together in order to perform styling on longer lengths of hair. As seen in FIG. 14, at least two top wavers 102 are interconnected and are shown preparing to mate with at least two bottom wavers 104 which are interconnected. In embodiments with at least two hair waver systems 100 interconnected the designated hair to be styled is sandwiched between the interconnected top wavers 102 and the interconnected bottom wavers.

Figure 15:
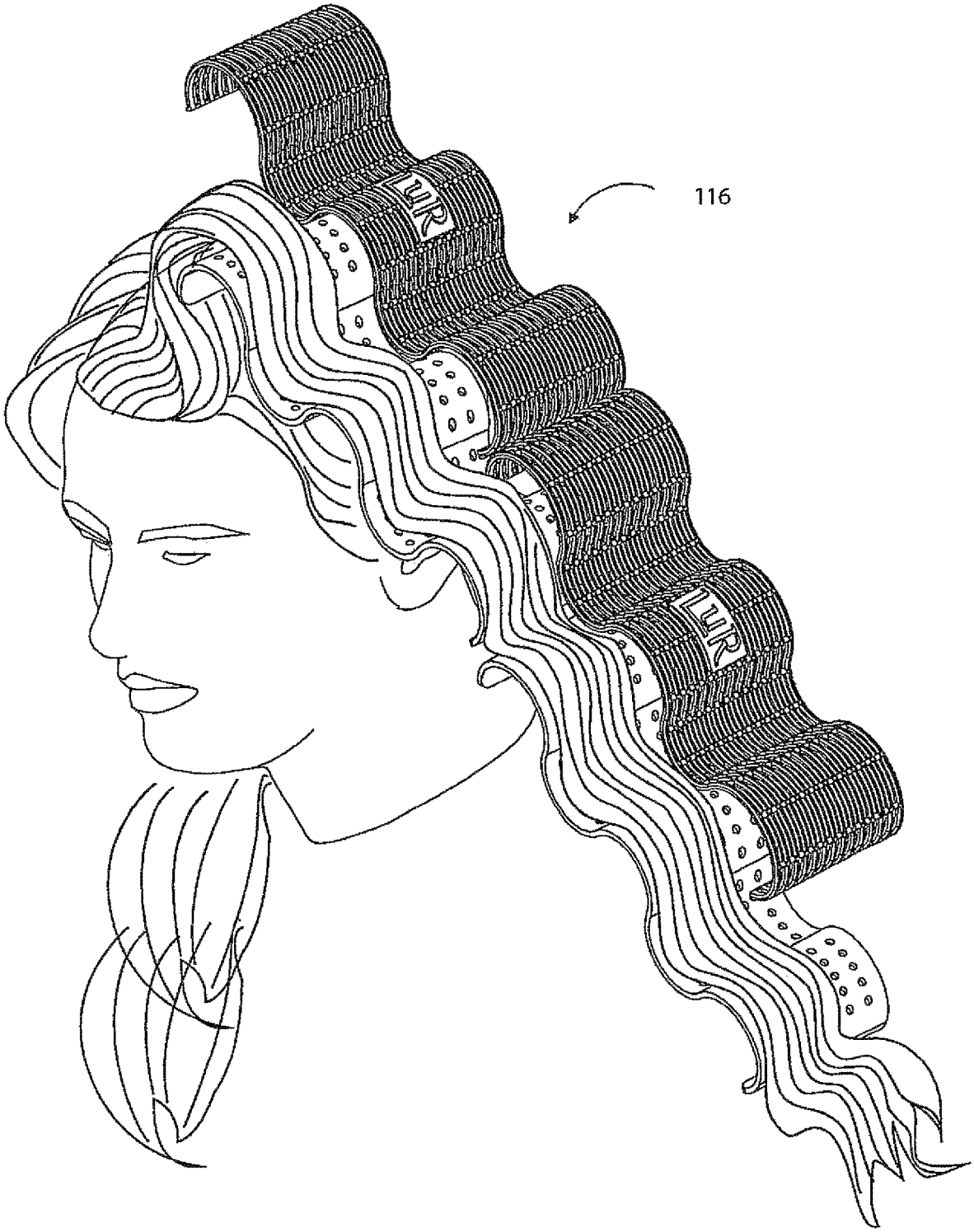
FIG. 15 presents interlocked components of a hair waver system in preparation to being applied.

FIG. 15 displays an interconnected hair waver 116 embodiment.

Figure 16:
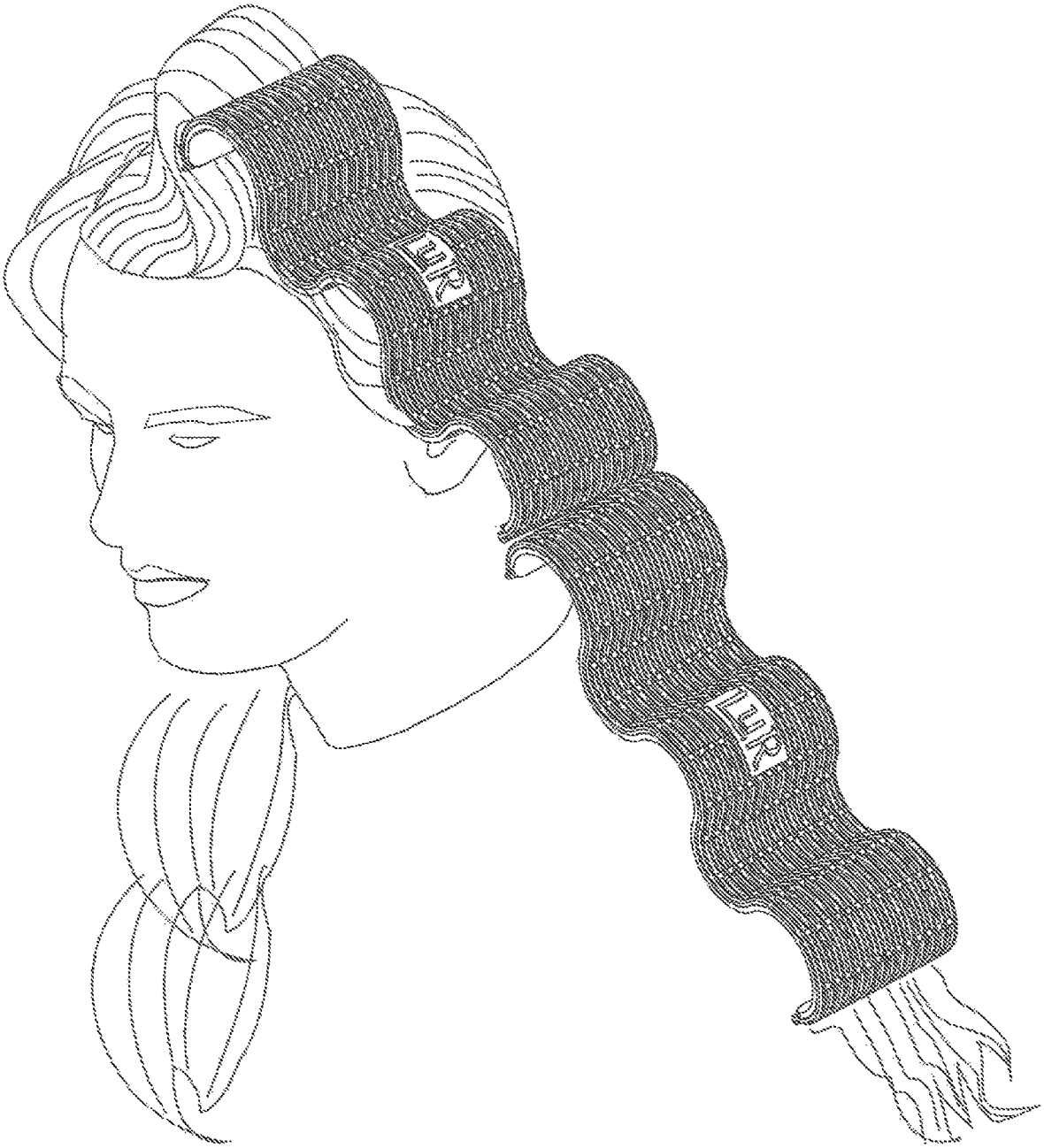
FIG. 16 presents interlocked components of a hair waver system applied to a person's hair.

FIG. 16 presents a deployed interconnected hair waver embodiment.

Figure 17:
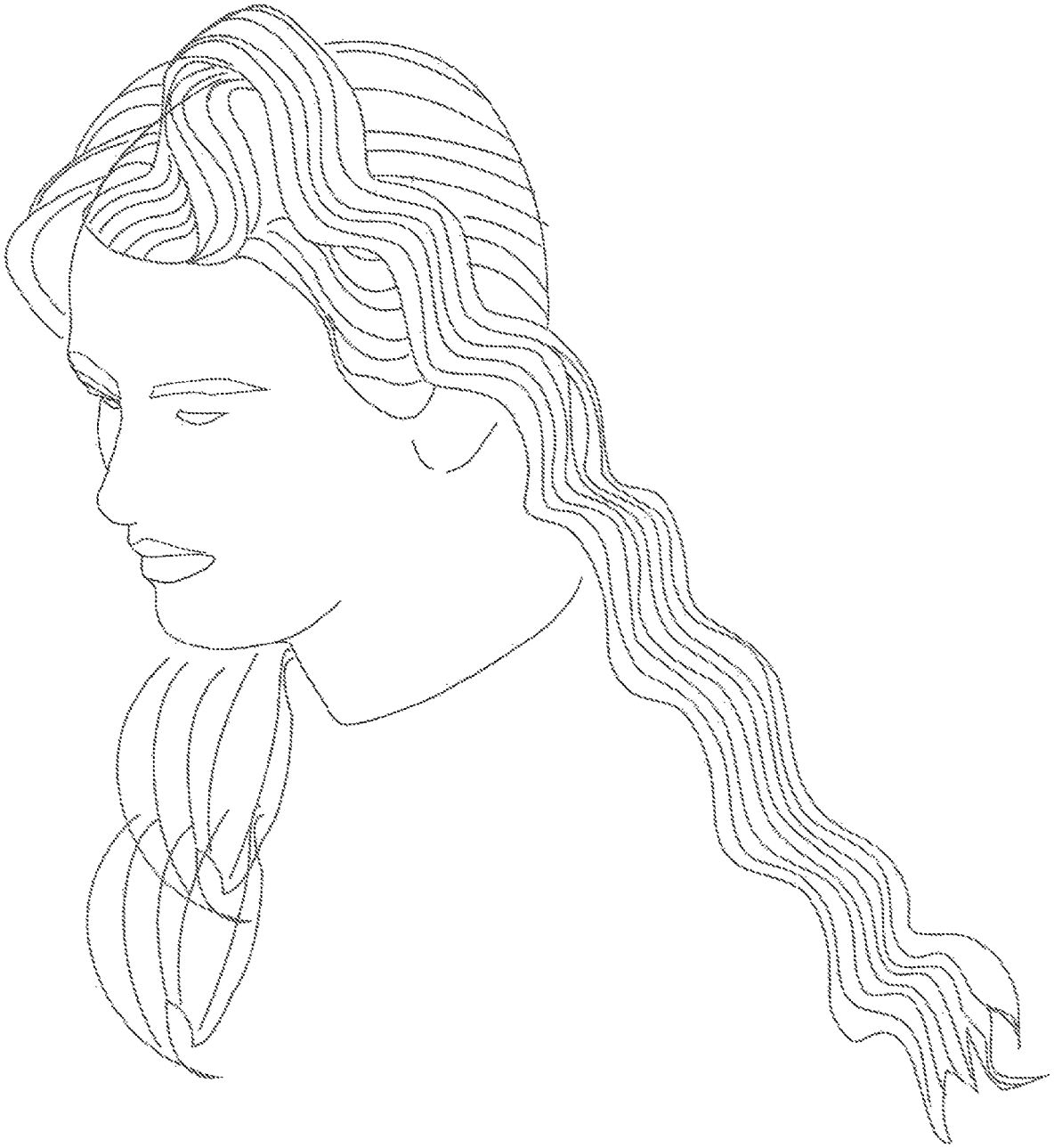
FIG. 17 presents a person's hair styled after having a hair waver system applied.

FIG. 17 presents the resulting stylized hair after utilizing an interconnected hair waver embodiment.

While the foregoing written description of the exemplary embodiments enables one of ordinary skill to make and use what is considered presently to be the best mode thereof, those of ordinary skill will understand and appreciate the existence of variations, combinations, and equivalents of the specific embodiment, method, and examples herein. The exemplary embodiments should therefore not be limited by the above described embodiment, method and examples, but all embodiments and methods within the scope and spirit of the exemplary embodiments as claimed.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

Insofar as the description above and the accompanying drawings disclose any additional subject matter that is not within the scope of the claims below, the inventions are not dedicated to the public and the right to file one or more applications to claim such additional inventions is reserved.

What is claimed:

1. A hair waver system consisting of:

a top waver;

a bottom waver configured to mate with the top waver;

wherein the bottom waver and the top waver include curved sections configured to mate with one another and to form a sandwich with hair intended to be styled in a middle of the sandwiched top and bottom wavers;

wherein the top waver includes a plurality of rectangular slotted openings;

wherein the top waver includes a raised tip on ends of the top waver;

wherein the top waver includes a plurality of ribs aligned in a perpendicular fashion to a length of the top waver;

wherein the plurality of ribs are separated from one another by a similar distance;

wherein the top waver includes a plurality of strips aligned in a lengthwise fashion along the length of the top waver;

wherein the plurality of strips are separated from one another by another similar distance;

wherein the rectangular slotted openings are formed from an intersection of the plurality of strips and the plurality of ribs;

wherein the top waver includes a rectangular component positioned on a central top surface of the top waver configured for commercially identifying the hair waver system;

wherein the bottom waver includes a plurality of circular openings;

wherein the plurality of circular openings are arranged in rows aligned along a length of the bottom waver;

wherein the rows include two sets of two rows with each set of two rows preferentially positioned towards sides of the bottom waver;

wherein the bottom waver includes a top surface which is substantially covered with a smooth surface; and wherein the outer ends of the top and bottom wavers include cusping wrap-around radial components which maintain the top waver and bottom waver mated and held together without additional connectors.

2. The hair waver system of claim 1 further comprising: at least two hair waver systems of claim 1, wherein a front of first hair waver abuts with a rear of a second hair waver and arranged to perform hair styling on longer lengths of hair.

* * * * *